US007866840B2

(12) United States Patent
Padden

(10) Patent No.: US 7,866,840 B2
(45) Date of Patent: Jan. 11, 2011

(54) FLASHLIGHT AS TOOL HANDLE

(75) Inventor: Stephen J Padden, Ventura, CA (US)

(73) Assignee: SOG Specialty Tools & Knives, L.L.C., Lynwood, WA (US)

( * ) Notice: Subject to any disclaimer, the term of this patent is extended or adjusted under 35 U.S.C. 154(b) by 143 days.

(21) Appl. No.: 12/008,478

(22) Filed: Jan. 11, 2008

(65) Prior Publication Data

US 2008/0212313 A1 Sep. 4, 2008

Related U.S. Application Data

(60) Provisional application No. 60/879,843, filed on Jan. 11, 2007.

(51) Int. Cl.
*F21V 33/00* (2006.01)

(52) U.S. Cl. ..... 362/119; 362/577; 362/191

(58) Field of Classification Search ..... 362/119, 362/18, 557, 578, 579, 116, 191, 399, 457, 362/253, 98, 109, 120, 396, 418, 427; 7/118, 7/163, 164, 167, 170

See application file for complete search history.

(56) References Cited

U.S. PATENT DOCUMENTS 4,449,474 A * 5/1984 Mariol ..... 116/2
5,313,376 A * 5/1994 McIntosh ..... 362/119
5,826,534 A * 10/1998 Huang ..... 116/137 R
5,897,200 A * 4/1999 Ho ..... 362/259
5,956,985 A * 9/1999 Chang ..... 70/456 R
6,135,608 A * 10/2000 Lin ..... 362/119
6,203,165 B1 * 3/2001 Chen ..... 362/119
6,364,500 B1 * 4/2002 McCalla et al. ..... 362/120
6,582,097 B2 * 6/2003 Chang ..... 362/253
6,986,590 B1 * 1/2006 Padden ..... 362/197
7,195,371 B2 * 3/2007 Thuma et al. ..... 362/199
7,360,914 B2 * 4/2008 Kim ..... 362/119
2005/0165404 A1 * 7/2005 Miller ..... 606/80
2005/0237736 A1 * 10/2005 Wimsatt ..... 362/196

* cited by examiner

*Primary Examiner*—Sandra L O Shea
*Assistant Examiner*—Leah S Lovell
(74) *Attorney, Agent, or Firm*—Brian G Forrest; Hughes Law Firm, PLLC

(57) ABSTRACT

A flashlight and tool combination comprises a flashlight having a body, an illumination member, a power source and a switch for switching the illumination member on and off. The flashlight body has on one portion thereof a tool connector. The combination further comprises a tool assembly comprising a tool component and a connector component, the connector component being received by the connector member on the body of the flashlight. A fastener for releasably securing the connector component to the connector member is provided.

15 Claims, 6 Drawing Sheets

12
10

16
12

14
18
20

26

28

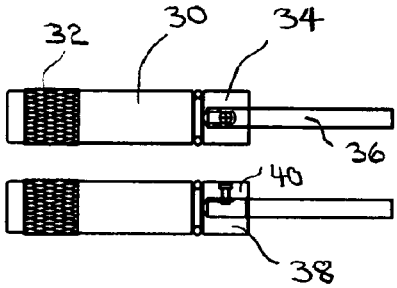
FIG. 6 (a)
FIG. 6 (b)
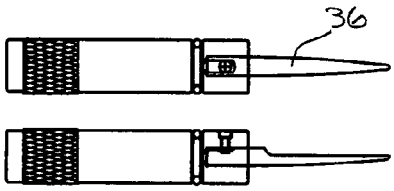
FIG. 7 (a)
FIG. 7 (b)
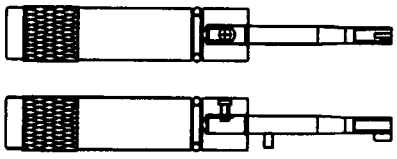
FIG. 8 (a)
FIG. 8 (b)
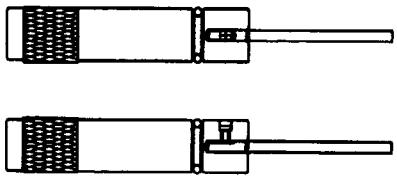
FIG. 9 (a)
FIG. 9 (b)
FIG. 10
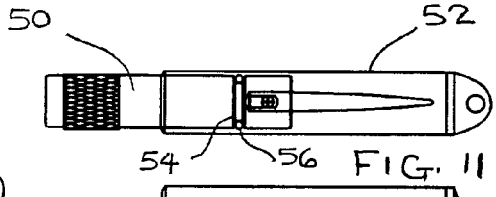
FIG. 11
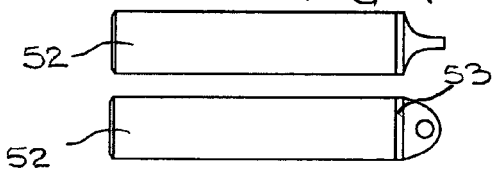
FIG. 12
FIG. 13
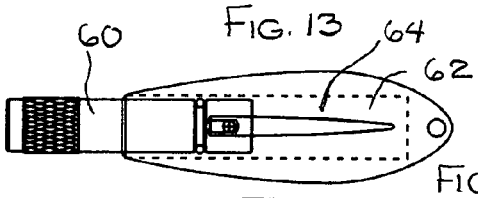
FIG. 14
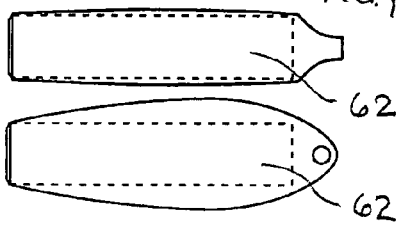
FIG. 15

FIG. 16
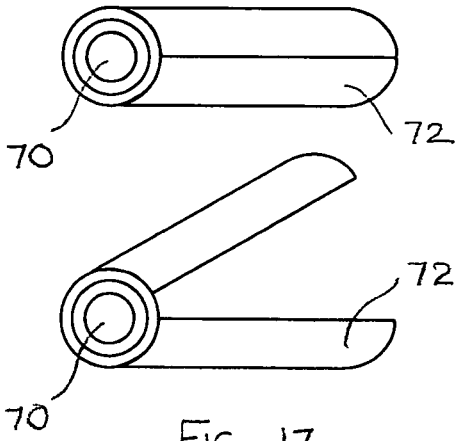
FIG. 17
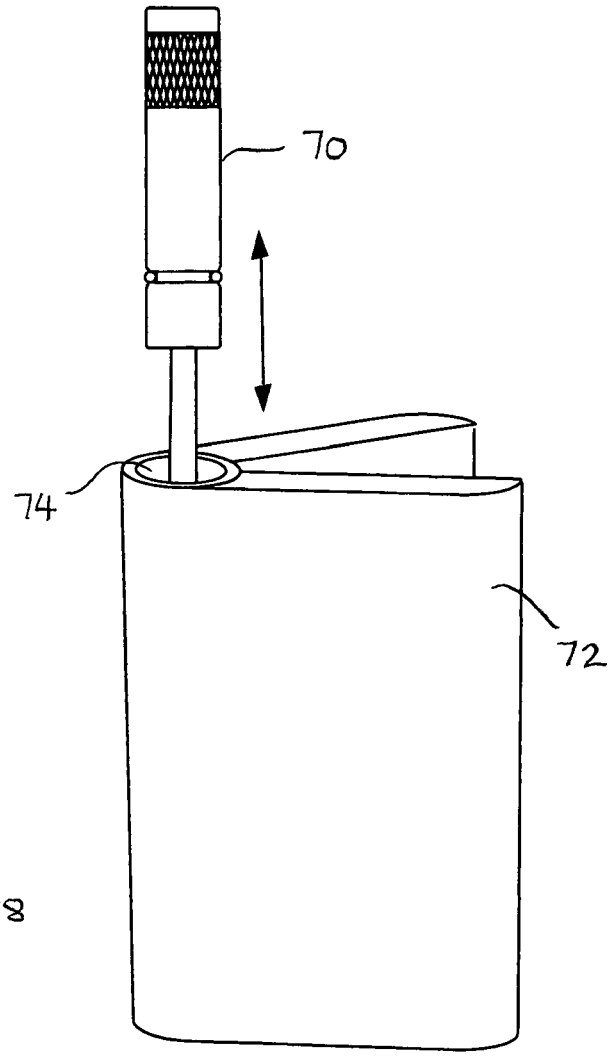
FIG. 18
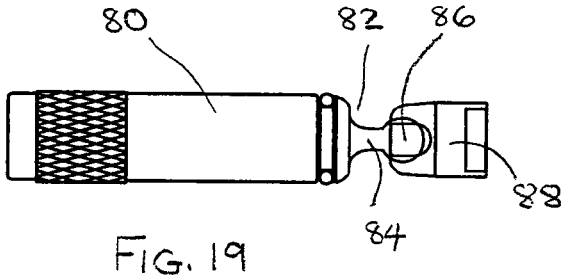
FIG. 19
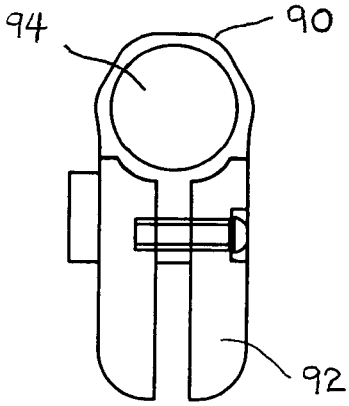
FIG. 20
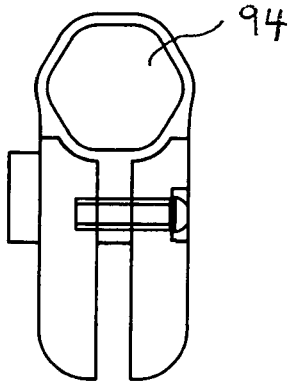
FIG. 21

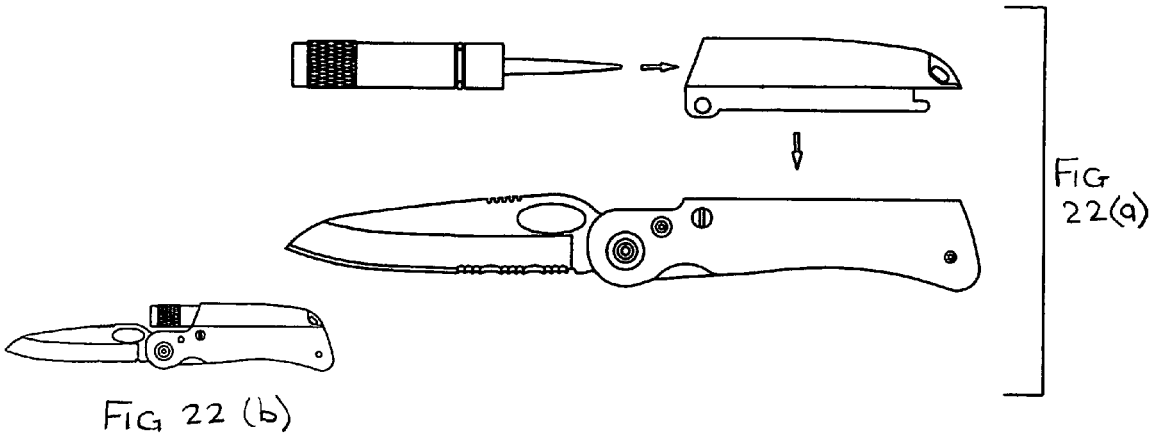
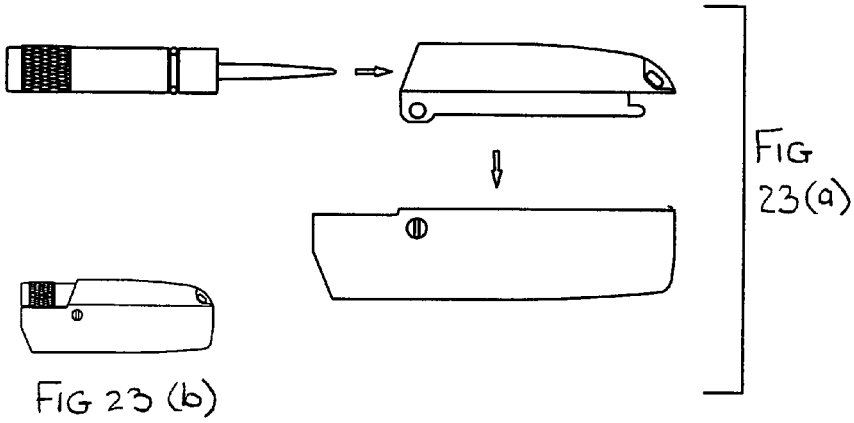
FIG. 24 (a)
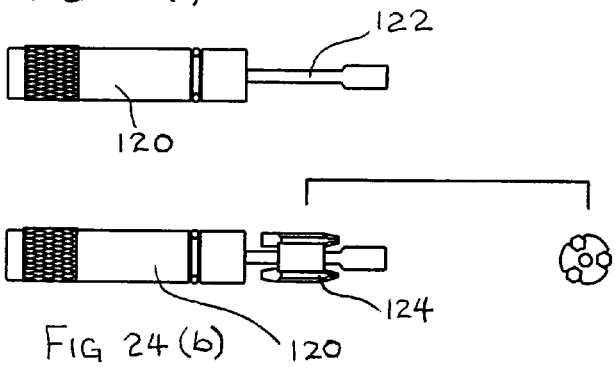
FIG 24 (b)

FIG. 25
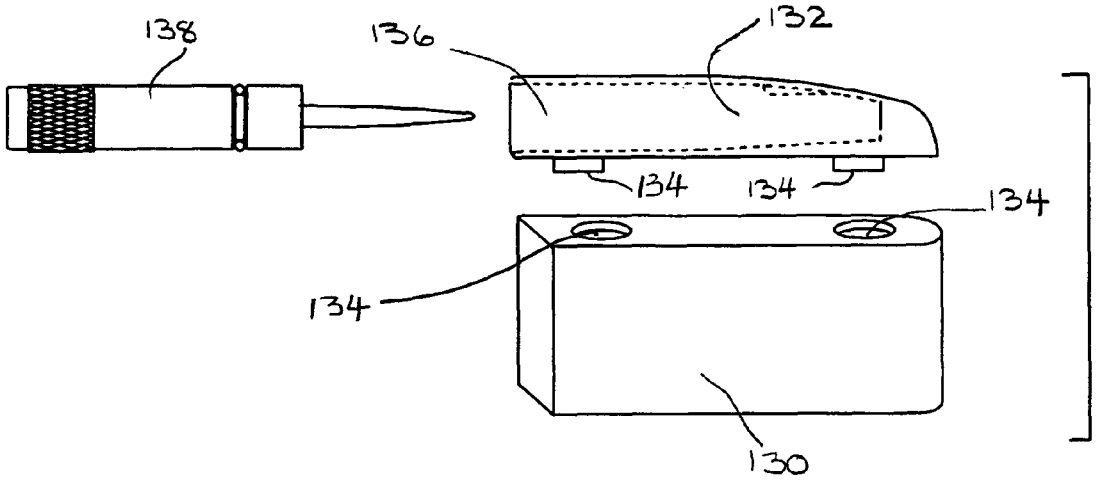
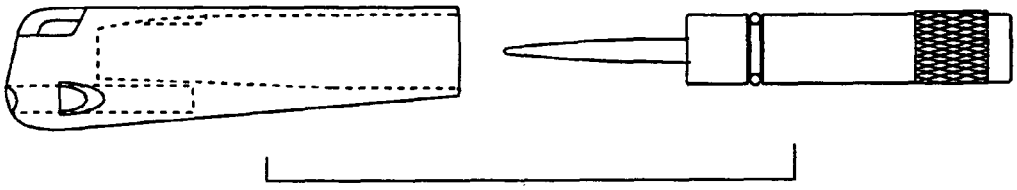
FIG. 26
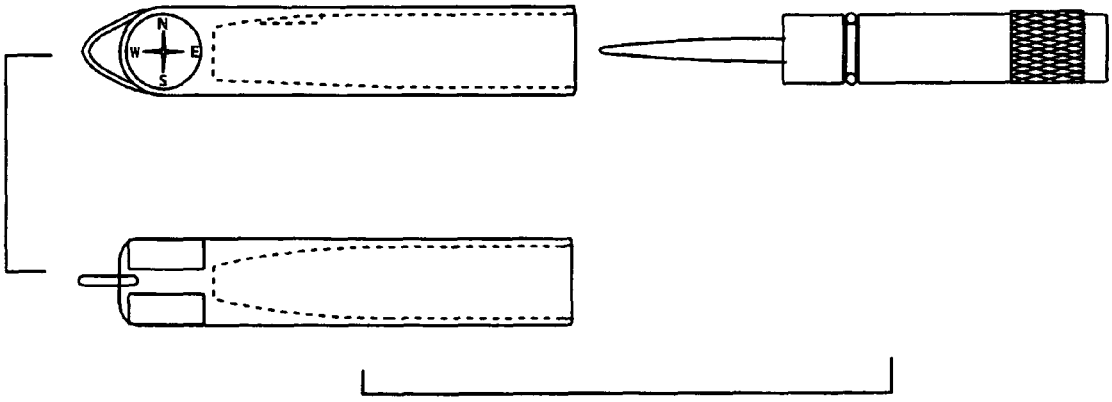
FIG. 27

FLASHLIGHT AS TOOL HANDLE

CROSS REFERENCE TO RELATED APPLICATIONS

This application claims the benefit of U.S. Provisional Patent Application No. 60/879,843 filed Jan. 11, 2007, which is incorporated herein be reference in its entirety.

FILED AND BACKGROUND OF THE INVENTION

This invention relates to a flashlight as a tool handle. More particularly, the invention in one form is for a flashlight, preferably a small or pocket type flashlight, which can be used as a handle for a variety of tools.

The invention acknowledges a basic concept, namely, that a flashlight is a very handy item to carry on, for example, a key ring or when enclosed within the body of another item. Therefore, in accordance with one aspect of the invention, there is provided a flashlight used as a substrate, base or handle for supporting another tool which can be used when attached to the flashlight and also when removed therefrom.

Compact tools are also at a premium, especially where weight is an important factor. Weight is, of course, an important factor in activities such as hiking, climbing etc. to name just a few examples. The list is endless and the breadth of application of the present invention is intended to cover this substantial list. In fact, lightweight accessories are generally prized for ease of carrying and the fact that they may require only small spaces for storage purposes.

SUMMARY OF THE INVENTION

The present invention provides in one aspect the utilization of a flashlight body as the handle for a wide range of tools. The desire and purpose may not be to illuminate a specific working area of the tool, although this is of course a possibility, but to provide two separate functions of a device, often carried as a commonly used attachment, in an extremely compact space.

As a key ring accessory, the flashlight and tool combination can be inserted into a "sleeve" or other structure of metal or plastic so that the head of the flashlight is exposed and ready for use to serve its function as an illuminator of an area. When the flashlight is removed from the sleeve, it may act as a handle for another, completely different tool or tools.

Using this same type of "sleeve" the flashlight and tool combination can, in one aspect of the invention, be built into the body of larger items, compact tool kits or items of daily use.

The individual tools that may fit into the back of the flashlight, or elsewhere on or in association with the flashlight, can be permanently fixed thereon, or they may be held by a screw or other device so that they are interchangeable with other tools designed to fit to and attach to the flashlight. Different tools may be stored in a device specially designed for that purpose until needed whereupon they will be fastened to the flashlight as described above.

The flashlight body can be cylindrical, hexagonal or any other convenient shape that can be inserted into a housing of similar dimension. A releasable mechanism for securing the flashlight to the "sleeve" may be required. This could be an O ring, a pressure fit, a ball detent, some form of flexible member or even magnets. The invention is not to be limited to any single or multiple mechanism for securing the tool, and any suitable mechanism for the intended purpose may be used.

Some tools that can be used with the flashlight as a handle do not require any resistance to torque (turning pressure). These could include among others: Fire starter; sharpener; saw blade; file (metal or nail file); wood rasp; blade; awl; glock tool (for field stripping a Glock pistol).

Some tools do require resistance to torque (turning pressure). These include: screwdriver (all types); key; handcuff key.

There are other types of tools and devices not on this list, and the scope of possibilities is not to be limited to the recited lists herein.

If the flashlight (as a handle) must resist turning pressure to torque, then it must preferably be constructed with a main barrel as one piece. Alternatively, it may be in more than one piece, in which case the parts must be secured so that they do not become unscrewed or detached or slip relative to each other as the tool is used.

Alternately, the flashlight itself could be inserted into a housing that would hold it and also the tool (at the back end). This housing could be made of plastic or metal. Then the flashlight could have any sort of construction, including a base that could screw on/off.

Drawings of these various construction possibilities form a part of this specification. These drawings show a representative variety of embodiments and possible uses for tools but are not meant to illustrate an exhaustive or complete list of tools.

BRIEF DESCRIPTION OF THE DRAWINGS

FIG. 1(*a*) is an end view of a flashlight shown in FIG. 1;

FIG. 2(*a*) is an end view of the flashlight and holder as shown in FIG. 2;

FIG. 6(*a*) is a top view of a further embodiment of the invention showing a flashlight and fire starter;

FIG. 6(*b*) is a side view of the flashlight shown in FIG. 6(*a*);

FIGS. 7(*a*) and 7(*b*) are top and side views respectively of an embodiment of the invention showing a flashlight with a diamond sharpener;

FIGS. 8(*a*) and 8(*b*) are top and side views respectively of an embodiment of the invention showing a flashlight with a handcuff key;

FIGS. 9(*a*) and 9(*b*) are top and side views respectively of an embodiment of the invention showing a flashlight with a glock tool;

FIG. 10 is a side view of a flashlight and tool of the invention inside a sleeve;

FIG. 11 is a top view of the sleeve only;

FIG. 12 is a side view of the sleeve only;

FIG. 13 shows another embodiment of a flashlight and tool of the invention inside a holder;

FIGS. 14 and 15 are top and side views respectively of the holder only, as shown in FIG. 13;

FIG. 16 shows a further embodiment of the invention of a flashlight as part of a card tool;

FIG. 17 is an end view of the flashlight and card tool shown in FIG. 16, but in the open position;

FIG. 18 is a perspective view of the flashlight, tool and card tool as shown in FIGS. 16 and 17;

FIG. 19 is a side view of a flashlight of the invention including a magnetic base;

FIG. 20 shows an end view of one embodiment of a knife with light, in accordance with the invention;

FIG. 21 shows another embodiment of a knife with light, in accordance with the invention;

FIGS. 22(*a*) and 22(*b*) show a tool, sleeve and knife, in accordance with the invention, including in exploded form and assembled;

FIGS. 23(*a*) and 23(*b*) show a tool, sleeve and tool case in accordance with the invention, including in exploded form and assembled;

FIGS. 24(*a*) and 24(*b*) show a flashlight tool in accordance with the invention, with a screw driver and socket respectively;

FIG. 25 shows a perspective view of another embodiment of a sleeve for a flashlight and tool;

FIG. 26 illustrates a stand alone flashlight and tool with a whistle;

FIG. 27 illustrates a stand alone flashlight and tool with a compass and thermometer;

DETAILED DESCRIPTION OF THE INVENTION

Figures 1, 2, 3, 4, 5:
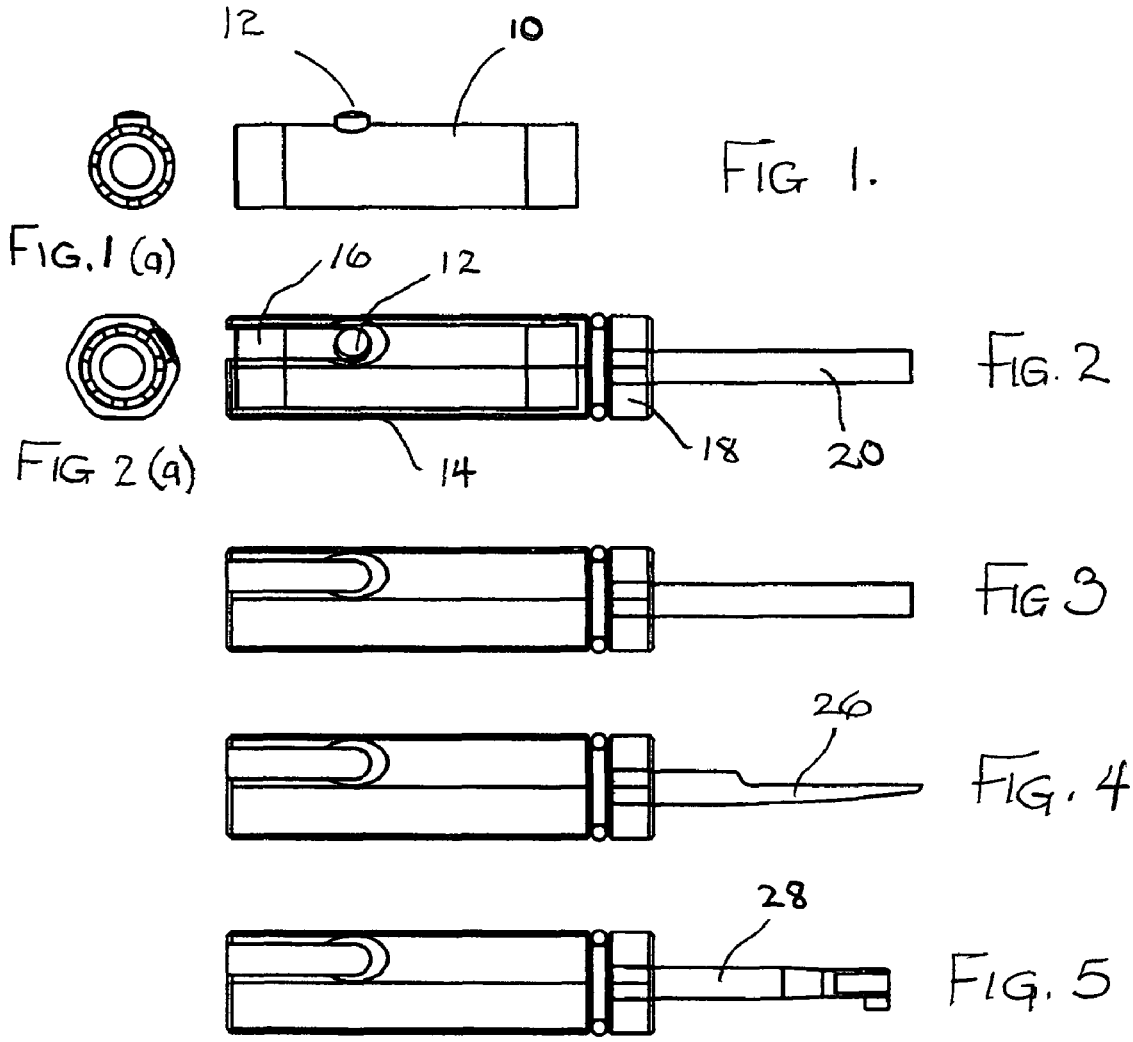
FIG. 1 is a side view of a flashlight only in accordance with the invention.
FIG. 2 is a side view of a flashlight with tool inside a holder in accordance with the invention.
FIG. 3 is a side view of a flashlight with a fire starter as tool.
FIG. 4 is a side view of a flashlight with a diamond sharpener as tool.
FIG. 5 is a side view of a flashlight with handcuff key as tool.
Figure 28:
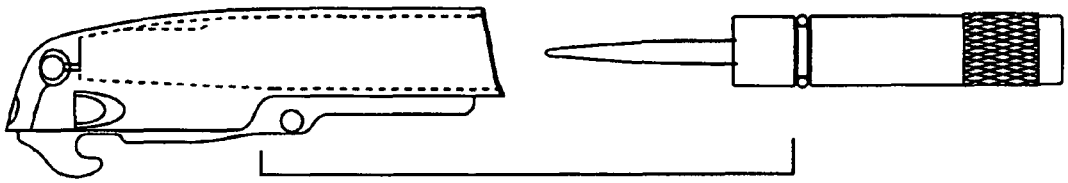
FIG. 28 illustrates a detachable flashlight and tool with a whistle.
Figure 29:
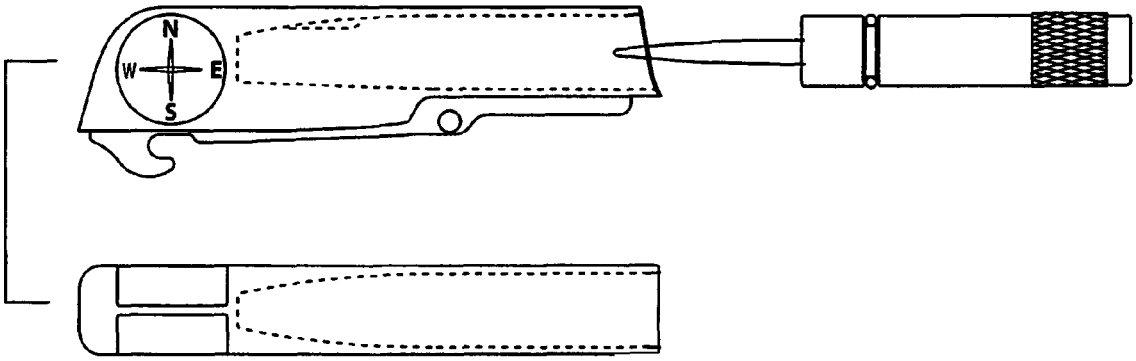
FIG. 29 illustrates a detachable flashlight and tool with a compass and thermometer.

In FIG. 1 of the drawings, there is shown a flashlight 10 only, of basic cylindrical shape, including a switch 12. One end of the flashlight 10 has an illumination bulb (not shown), which can be conventionally switched on and off, and the flashlight 10 is powered by one or more batteries contained within the cylindrical housing.

In FIGS. 2 and 2(*a*) there is shown a flashlight 10, generally of the type shown in FIG. 1 of the drawings, located within a holder 14 to which it can be releasably secured. This can be done using a set screw, or such other device as may be appropriate. The holder 14 includes a slot 16 for accommodating the switch 12 as the flashlight 10 slides into and out of the holder 14. At one end of the holder 14, there is formed a tool base 18, and a tool 20 extends from the tool base 18. Between the holder 14 and the tool base 18, there is provided a channel 22 in which is located an O-ring 24. The O-ring 24 allows the flashlight 10, surrounding holder 14, and such other components to be securely but releasably received within a sleeve, not shown in the present embodiment, although illustrated and described below.

In FIG. 2 of the drawings, the tool 20 comprises an alloy fire starter.

FIG. 3 shows a view of the invention as generally shown in FIG. 2 of the drawings, but wherein the flashlight has been removed. The flashlight 10 can be conveniently removed and replaced at desired by the user.

FIGS. 4 and 5 of the drawings show a holder and tool, wherein the flashlight has been removed, FIG. 4 showing the tool comprising a diamond sharpener 26, and FIG. 5 showing the tool comprising a handcuff key 28.

In all of FIGS. 1 to 5 above, it will be appreciated that the flashlight 10 is activated, namely, the bulb is illuminated, by means of the on/off switch 12 which is located on the wall thereof.

In FIGS. 6(*a*) and 6(*b*), there is shown another embodiment of the flashlight and tool of the invention, including a flashlight 30, having a textured surface 32 at one point, the textured surface 32 comprising a gripping point whereby one part of the flashlight 30 can be rotated or twisted with respect to another, so as to switch the illuminate member of the flashlight on and off. The flashlight with tool also comprises a tool base 34 and tool 36, which in FIGS. 6(*a*) and 6(*b*) of the invention comprises a magnesium alloy fire starter. It will be seen that the tool 36 is able to fit within an aperture in the tool base 34, and that the tool 36 can be releasably secured within the aperture 38 by means of a set screw 40. Other securing means can be used.

FIGS. 7(*a*) and 7(*b*) show embodiments similar to those shown in FIGS. 6(*a*) and 6(*b*) but wherein the tool comprises a diamond sharpener.

In FIGS. 8(*a*) and 8(*b*), the tool comprises a handcuff key, while in FIGS. 9(*a*) and 9(*b*), the tool comprises a glock tool for stripping a glock pistol.

With reference to FIG. 10 of the drawings, there is shown a flashlight and tool device 50, generally of the type shown in FIGS. 6 to 9, formed within a key ring sleeve 52. It will be seen that the flashlight itself has a channel 54 in which is located an O-ring 56, and the O-ring 56 tightly engages the inner surface of the key ring sleeve 52 so as to frictionally engage the flashlight 50 with the sleeve 52, and prevent simple falling out of the flashlight from the sleeve. The key ring sleeve 52 can be made of plastic, metal, aluminum or any other desired material.

FIG. 11 shows a top view of the sleeve 52, without the flashlight and tool 50, and FIG. 12 shows a side view of the sleeve 52, also with the flashlight and tool 50 removed therefrom. FIG. 12 also illustrates the presence of an air escape hole 53 through which air can be discharged and pressure released during insertion of the flashlight and tool 50 into the sleeve 52.

With reference to FIG. 13 of the drawings, there is shown a flashlight and tool 60 formed within a sleeve 62 of different shape to that shown in FIG. 10, the sleeve 62 also comprising a key ring attachment. It will be seen that the sleeve 62 has a contoured edge, but also defines the internal chamber 64 which snugly receives the flashlight and tool 60. FIG. 14 illustrates a top view of the sleeve 62 in FIG. 13 with the flashlight and tool 60 removed, while FIG. 15 is a side view of the sleeve 62 with the flashlight and tool 60 removed. One advantage of a sleeve 62 of the shape shown in FIGS. 13 to 15 is to provide a bigger imprint or working area for printed material, such as personal or other identification information, logos, advertising or the like.

FIGS. 16 to 18 of the drawings show a flashlight and tool assembly, indicated by reference numeral 70, forming part of a card tool 72 having tool components and which can open and close much like a book. The tools contained by the card tool 72 will be on the inside of the card tool 72. FIG. 16 shows an end view with the card tool 72 in the closed position, while FIG. 17 shows an end view with the card tool 72 in the partially open position. FIG. 18 shows a perspective view, indicating how the flashlight and tool device 70 may be received within the chamber 74 formed in the pivoting portion of the card tool 72.

FIG. 19 shows a flashlight 80 generally of the type shown in FIGS. 6 to 9, including a tool base 82, to which is attached a neck 84, terminating in a ball 86. The ball 86 has mounted thereon a magnet 88, the ball 86 formed within a recess of the magnet 88 so that the magnet 88 is movable as is typical in ball-and-socket type arrangements. The magnet 88 may be used to secure or fasten the flashlight 80 to a magnetic surface, such as in the working area, and the position of the flashlight 80 can be pivotally adjusted relative to the magnet 88 so as to direct a beam of light emanating from the flashlight 80 into a desired area.

With reference to FIGS. 20 and 21, there is shown an end view of a flashlight and tool mounted on a knife. In FIG. 20, a sleeve 90 is releasably mounted on a knife 92, the sleeve 90 having a chamber 94 for receiving a flashlight. FIG. 21 is substantially the same as the arrangement shown in FIG. 20, save that the chamber 94 is hexagonal, as opposed to circular, in cross-section. A hexagonal chamber has the effect of ensuring that when a flashlight is mounted therein, the flashlight will not rotate in the chamber.

In FIG. 22(*a*) of the drawings, there is shown, in exploded view, a knife 100 having a handle 102 and a blade 104 which pivots in the handle 100. A sleeve 106, having a depending flange 108, fits on the upper surface of the handle 102 of the knife 100, sliding therein or engaging therein in a releasable fashion so that it can be selectively attached to the knife 100.

The sleeve 106 defines a chamber 110 therein in which is received a flashlight and tool 112 which fits into the sleeve 106 in much the same way as described with respect to embodiments and examples above. FIG. 22(*b*) shows the assembled form of the exploded components illustrated in FIG. 22(*a*) of the drawings.

In FIG. 23(*a*), there is shown a similar situation as described with respect to FIG. 22(*a*), but instead of a knife 100, there is provided a tool case 116 which receives the sleeve 106, which in turn accommodates the tool 112. A complete assembled form of the exploded version shown in FIG. 23 is illustrated in FIG. 23(*b*).

In FIGS. 22 and 23, there is also illustrated the presence of a whistle which can be built into the sleeve, a unique feature useful, for example, for emergency workers, hikers or others who may wish to draw attention to themselves or an ongoing or developing situation.

FIGS. 24(*a*) and 24(*b*) show a flashlight and tool 120 respectively, FIG. 24(*a*) illustrating a screwdriver 122 attached to the tool 120, while FIG. 24(*b*) illustrating a socket arrangement 124.

FIG. 25 shows an alternative sleeve attachment for a flashlight and tool combination of the invention, showing, schematically, a main tool case, or knife 130, and a sleeve 132, which attaches to the case 130 by means of a plurality of magnets 134 appropriately disposed on the upper surface of the case 130 and the lower surface of the sleeve 132. As has been described above, the sleeve 132 will include a chamber 136, in which is received a flashlight and tool 138.

The invention claimed is:

1. A flashlight and tool combination comprising:

a flashlight having a body, an illumination member, a power source and a switch for switching the illumination member on and off;

a holder to receive the flashlight, the holder having on one portion thereof a tool connector member, the holder including a slot for accommodating a switch on the flashlight;

a tool assembly comprising a tool component and a connector component, the connector component being received by the tool connector member; and means for releasably securing the connector component to the tool connector member, wherein the flashlight body is generally of cylindrical shape and has first and second substantially opposing ends, the illumination member being located at the first end of the flashlight body and the tool connector being located at the second end of the flashlight body.

2. The flashlight and tool combination as claimed in claim 1 furtherance comprising a sleeve for receiving at least in part the flashlight and the tool assembly.

3. The flashlight and tool combination as claimed in claim 2 wherein the sleeve defines a chamber which is circular.

4. The flashlight and tool combination as claimed in claim 2 wherein the sleeve defines a chamber which is hexagonal.

5. The flashlight and tool combination as claimed in claim 2 wherein the sleeve has a connector flange which is received by a connector channel for mounting on a knife.

6. The flashlight and tool combination as claimed in claim 2 wherein the sleeve is comprised of one or more of the following materials: metal, plastic, and aluminum.

7. The flashlight and tool combination as claimed in claim 2 wherein the sleeve has a connector flange which is received by a connector channel for mounting on a tool case.

8. The flashlight and tool combination as claimed in claim 2 further comprising a recess containing an O-ring, the O-ring engaging an inner surface of the sleeve to facilitate securing of the flashlight and tool in the sleeve.

9. The flashlight and tool combination as claimed in claim 2 wherein the sleeve comprises an aperture for a metal ring so that keys or other objects can be fastened to the sleeve through the metal ring.

10. The flashlight and tool combination as claimed in claim 2 wherein illumination member and switch are exposed when the body of the flashlight is in the sleeve so that the flashlight can be switched on and off and the light of the illumination member can be used when the body is in the sleeve.

11. The flashlight and tool combination as claimed in claim 1 wherein the connector component is releasably secured to the connector member by means of a set screw.

12. The flashlight and tool combination as claimed in claim 1 wherein the tool component is selected from one or more of: a fire starter; diamond sharpener; handcuff key; gun tool; card tool; magnet; knife; screwdriver; and socket.

13. The flashlight and tool combination as claimed in claim 12 as a kit, the kit including a plurality of tool assemblies each tool assembly having a different tool component.

14. The flashlight and tool combination as claimed in claim 1 wherein the sleeve includes a whistle.

15. The flashlight and tool combination as claimed in claim 1 further comprising at least one of: whistle, thermometer, compass.

* * * * *